US011680707B2

(12) United States Patent
Benvenuto et al.

(10) Patent No.: US 11,680,707 B2
(45) Date of Patent: Jun. 20, 2023

(54) WATER-HEATING APPARATUS COMPRISING COMBUSTIBLE GAS BURNER, IN PARTICULAR A STORAGE WATER HEATER

(71) Applicant: SIT S.P.A., Padua (IT)

(72) Inventors: Michele Benvenuto, Maserada sul Piave (IT); Michele Ciscato, Charlotte, NC (US)

(73) Assignee: SIT S.P.A., Padua (IT)

( * ) Notice: Subject to any disclaimer, the term of this patent is extended or adjusted under 35 U.S.C. 154(b) by 5 days.

(21) Appl. No.: 17/279,805

(22) PCT Filed: Sep. 17, 2019

(86) PCT No.: PCT/IB2019/057808

§ 371 (c)(1),
(2) Date: Mar. 25, 2021

(87) PCT Pub. No.: WO2020/065444

PCT Pub. Date: Apr. 2, 2020

(65) Prior Publication Data

US 2022/0034508 A1 Feb. 3, 2022

(30) Foreign Application Priority Data

Sep. 28, 2018 (IT) ..... 102018000009031

(51) Int. Cl.
*F23Q 9/12* (2006.01)
*F23Q 3/00* (2006.01)
(Continued)

(52) U.S. Cl.
CPC ..... *F23Q 9/12* (2013.01); *F23Q 3/008* (2013.01); *F24H 1/186* (2013.01); *F24H 9/2035* (2013.01)

(58) Field of Classification Search
USPC ..... 431/47
See application file for complete search history.

(56) References Cited

U.S. PATENT DOCUMENTS 2,520,961 A 9/1950 Ray
3,325,099 A * 6/1967 Jackson ..... G05D 23/128 236/21 B (Continued)

FOREIGN PATENT DOCUMENTS

JP H08 21625 A 1/1996

*Primary Examiner* — Steven B McAllister
*Assistant Examiner* — John E Bargero
(74) *Attorney, Agent, or Firm* — Volpe Koenig

(57) ABSTRACT

An apparatus for heating water comprises a main burner, a pilot burner, a valve assembly with a main valve and a pilot valve having a shutter, a magnetic thermoelectric safety assembly with a thermocouple device holding the pilot valve open in the presence of a flame in the pilot burner, a button member mounted on a rod that is slidingly guided in the valve assembly and an electrical ignition member supplied via an electrical connection circuit, a switch device in the circuit being designed to be switched by means of the button member so as to close the electrical circuit when said button member is pressed in order to carry out actuation of the magnetic assembly so as to open the passage of gas through the pilot valve towards the pilot burner and to ignite the pilot flame by means of the sparks generated by the ignition member.

3 Claims, 5 Drawing Sheets

(51) Int. Cl.
*F24H 1/18* (2022.01)
*F24H 9/20* (2022.01)

(56) References Cited

U.S. PATENT DOCUMENTS

| | | | | | |
|---|---|---|---|---|---|
| 3,626,131 | A | * | 12/1971 | Barney | H01H 13/20 200/294 |
| 3,915,207 | A | * | 10/1975 | Greenfield, Jr. | A47J 31/401 141/85 |
| 4,778,378 | A | | 10/1988 | Dolnick et al. | |
| 4,806,095 | A | | 2/1989 | Goldstein et al. | |
| 2003/0230339 | A1 | * | 12/2003 | Home | F16K 31/402 137/66 |
| 2017/0004938 | A1 | * | 1/2017 | Hintz | H01H 13/06 |
| 2018/0142922 | A1 | | 5/2018 | Knoeppel et al. | |

* cited by examiner

WATER-HEATING APPARATUS COMPRISING COMBUSTIBLE GAS BURNER, IN PARTICULAR A STORAGE WATER HEATER

TECHNICAL FIELD

The present invention relates to a water-heating apparatus comprising a combustible gas burner.

TECHNOLOGICAL BACKGROUND

The invention is particularly applicable to the technical field of apparatuses for heating domestic water, known as storage water heaters.

To be specific, these combustible gas apparatuses typically comprise a pilot burner for generating a pilot flame and a main burner for generating a main flame, in which combustion in the main burner is triggered by means of the pilot flame. The invention can be found in particular in the field of apparatuses for heating water, in which a continuous pilot burner is used, that is having a permanent flame, whereby the pilot flame is kept alive from the moment that the apparatus is ignited until it is extinguished.

Apparatuses of this type generally are not connected to the mains. In said apparatuses, a magnetic safety assembly is associated with the pilot valve, which comprises a thermocouple provided with a manual actuating system, and at least one main valve having a thermomechanical operator for controlling a gas circuit towards a main burner.

The lighting of the main burner according to the heat requirement is managed by a mechanical thermostat, for example formed having a bimetalic differential expansion sensor, which is inserted into the water storage tank.

This type of continuous pilot heating apparatuses is characterised by manual lighting of the pilot burner that, in some aspects, may not be particularly convenient for the user. When lighting the burner, the user is in fact required to press the button or knob of the actuating assembly for a certain amount of time (normally by pressing the button with a finger the button counter to the action of a spring system having springback) and while simultaneously actuating the igniter (generally a piezoelectric igniter), and then to release the button as soon as the thermocouple activated by the flame has energised the magnetic assembly of the pilot valve. The button is released by the user once he has detected the persistence of the flame ignited in the pilot burner.

The user therefore has to perform two separate movements using both hands for the respective actions that simultaneously take place (pressing the button and actuating the spark generator of the piezoelectric igniter), actions that are often carried out in a rather inconvenient position, given that the valve assembly of the apparatus is normally located in the lower region of the water tank of the heater, near to the region of the storage tank that is supported on the ground.

Other disadvantages can also occur during the ignition step. In fact, if the user wants to proceed with the ignition process, in particular after the apparatus has been turned off for a long time, as a result of which the pilot pipe for the gas is full of air, the user is forced to press and hold the button for a rather long time, until all the air has left, allowing the gas to enter the pilot burner. During this time, the user also continues to press the piezoelectric igniter, which is in fact of no use until the gas enters at the point of ignition. Furthermore, the pressure on the piezoelectric igniter generates just one spark, therefore, in order to ignite the pilot burner, several attempts (or sparks) need to be made under the best conditions to ignite the flame on arrival of the gas when the air has been emptied from inside the pipe.

DESCRIPTION OF THE INVENTION

A main object of the present invention is to provide a water-heating apparatus, which comprises a combustible gas burner and the structure and function of which are designed to overcome the limitations indicated above with reference to the known solutions.

This and other objects that will become clear in the following are achieved by the invention by means of a water-heating apparatus comprising a combustible gas burner formed in accordance with the attached claims.

BRIEF DESCRIPTION OF THE DRAWINGS

Further features and advantages of the invention will be clearer from the following detailed description of a few preferred embodiments thereof, which are illustrated by way of non-limiting example and with reference to the attached drawings, in which.

PREFERRED EMBODIMENTS OF THE INVENTION

Figure 1:
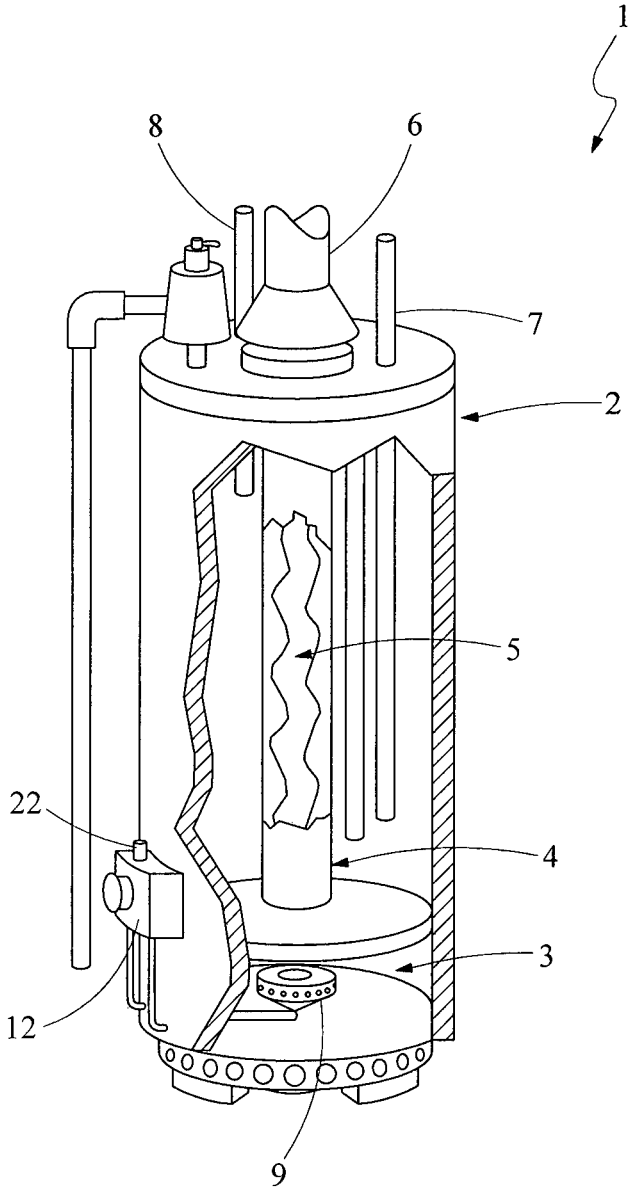
FIG. 1 is a perspective and partially sectional schematic view of a water heater, comprising a gas burner formed according to the invention.

With reference to the cited figures, 1 indicates as a whole (and only schematically in FIG. 1) an example of a water-heating apparatus comprising a combustible gas burner, which is formed in accordance with the present invention.

Said apparatus is designed as a domestic water heater comprising a storage tank 2. A combustion chamber 3 is defined in the lower part of the tank, in which a combustible gas burner assembly is arranged. A pipe 4 for discharging fumes extends from the combustion chamber 3, which, by extending vertically in a central position inside the tank, is connected to a heat-exchanging device 5 that recovers heat from the combustion fumes in order to heat the water stored in the tank. The combustion gases leaving the exchanger are discharged by means of a chimney 6 arranged on the outside of the upper part of the tank 2.

7 and 8 mark respective tubes that supply the water to the tank 2, for example from the water supply network, and remove the hot water from said tank.

More specifically, the heating apparatus 1 comprises a main burner 9 arranged in the combustion chamber 3, in which a main flame is generated, a pilot burner 10 suitable for generating a pilot flame for igniting the main burner 2, and a valve assembly 11.

The valve assembly is defined in a valve body 12 designed to be applied to the tank in a lower region thereof, near to the combustion chamber 3 and at a short distance from the bearing plane of the tank on the ground.

The valve assembly 11 comprises a main valve 13 arranged on a main pipe 14 of the valve assembly for supplying the combustible gas to the main burner 9, and a pilot valve 15 arranged on the pipe 14, upstream of the main valve, for supplying the gas to the pilot burner.

The pilot valve 15 is provided with a valve seat 16 that cooperates with a particular shutter 17 (mounted on a rod 17*a*) that is associated with a springback spring 18 when closed.

19 indicates a pilot pipe, which branches off from a portion 14*a* of the main pipe 14 that is interposed between the pilot valve 15 and the main valve 13 and is suitable for supplying the gas to the pilot burner 10.

Said pilot burner 10 is suitably designed as a continuous pilot burner, that is having a permanent flame.

A magnetic thermoelectric safety assembly 20 having a manual actuating that comprises a thermocouple device 21 that holds the pilot valve 15 open in the presence of a flame in the pilot burner 10, and a member that is designed having a button 22 and is mounted coaxially at one end of a rod 23 such that it can be pressed, for example by exerting a pressure using a finger of one hand, are also provided in the valve assembly 11.

Said rod 23 is slidingly guided in the valve assembly and operatively associated with the shutter 17 of the pilot valve such that, after pressure has been exerted on the button member 22, the rod 23 is moved in said sliding direction (indicated by X in the drawings) until it interferes with the shutter 17 (or with the actuator rod 17*a* thereof) of the pilot valve (by moving the shutter away from the valve seat) following a preset axial movement, in order to open said pilot valve, thereby allowing gas to pass along the pilot pipe 19.

In the presence of a flame in the pilot burner 10, the power generated by the thermocouple device 21 (inserted into the flame) is suitable for supplying power to the magnet of the magnetic safety assembly in order to keep the shutter 17 far away from the particular valve seat 16 counter to the springback action of the spring 18.

25 indicates an ignition member as a whole, which is shown schematically in the drawings and is designed to generate sparks near the pilot burner 10 in order to cause the ignition of the gas supplied to the pilot burner and to consequently generate the pilot flame.

The member 25 is designed as an electrical igniter and comprises complex circuitry in which the related voltage booster is housed in a body 26 of the igniter 25, which is electrically connected to an electrode or tip 27 arranged in the pilot burner.

The igniter 25 is supplied with power by an electricity source 28 via an electrical connection circuit 29, a switch device 30 being provided in the circuit to open or close said circuit by interrupting or allowing the supply of power to the igniter, respectively.

The switch device 30 is also designed to be switched by means of the button member 22 so as to close the electrical circuit 29 when said button member is pressed in order to carry out the actuation of the magnetic assembly 20 so as to open the passage of gas through the pilot valve 15 towards the pilot burner 10 and to simultaneously cause the pilot flame to be ignited by means of the sparks generated by the ignition member 25.

In one embodiment, the source that supplies power to the igniter is a battery that can supply a DC voltage of a few volts (for example 1.5 volts), intended to be increased by a transformer of the complex circuitry of the igniter into a voltage of a few kilovolts (for example 12 kV). With this configuration, it is possible for the electrode 27 to generate a string of sparks at a preset rate, which are energetically stable and therefore effective for inducing the ignition of the flame in the pilot burner.

Figure 2:
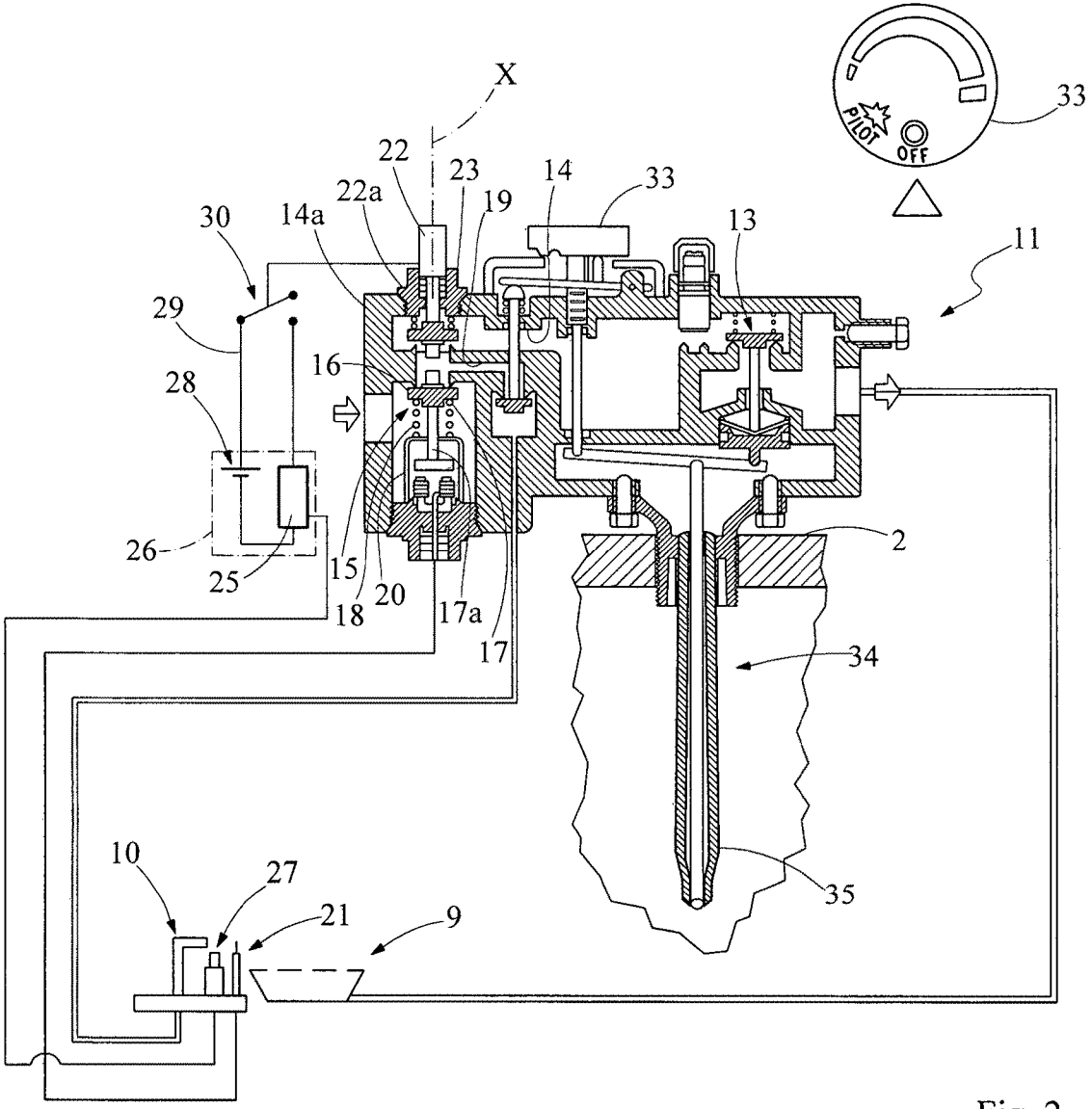
FIG. 2 is a longitudinal sectional schematic view of an embodiment of the valve assembly of the water-heating apparatus in FIG. 1, FIGS. 3 and 4 are views that correspond to that in FIG. 1, in which the valve assembly in the previous figure is in different operating stages.
Figure 3:
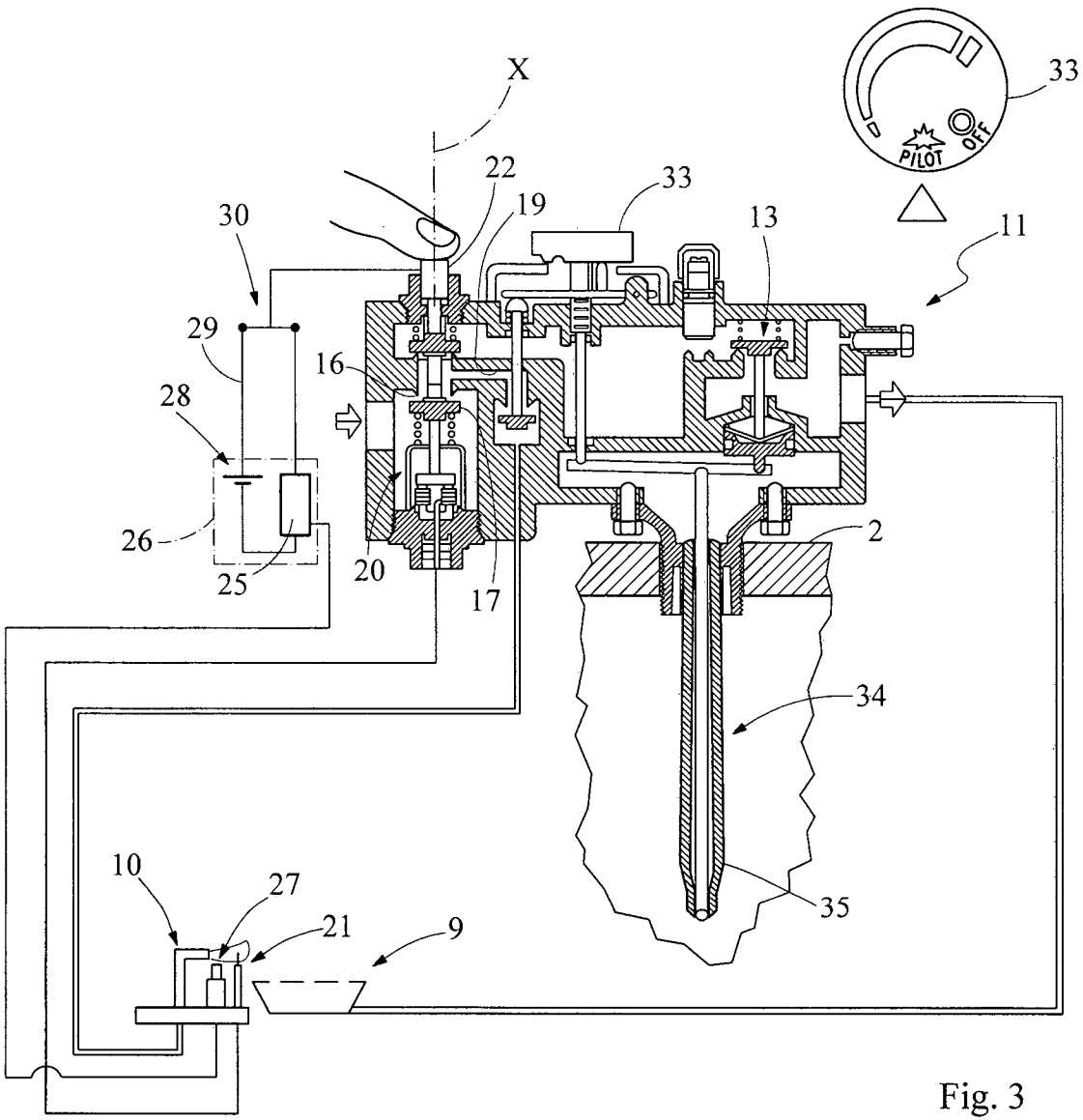
Figure 4:
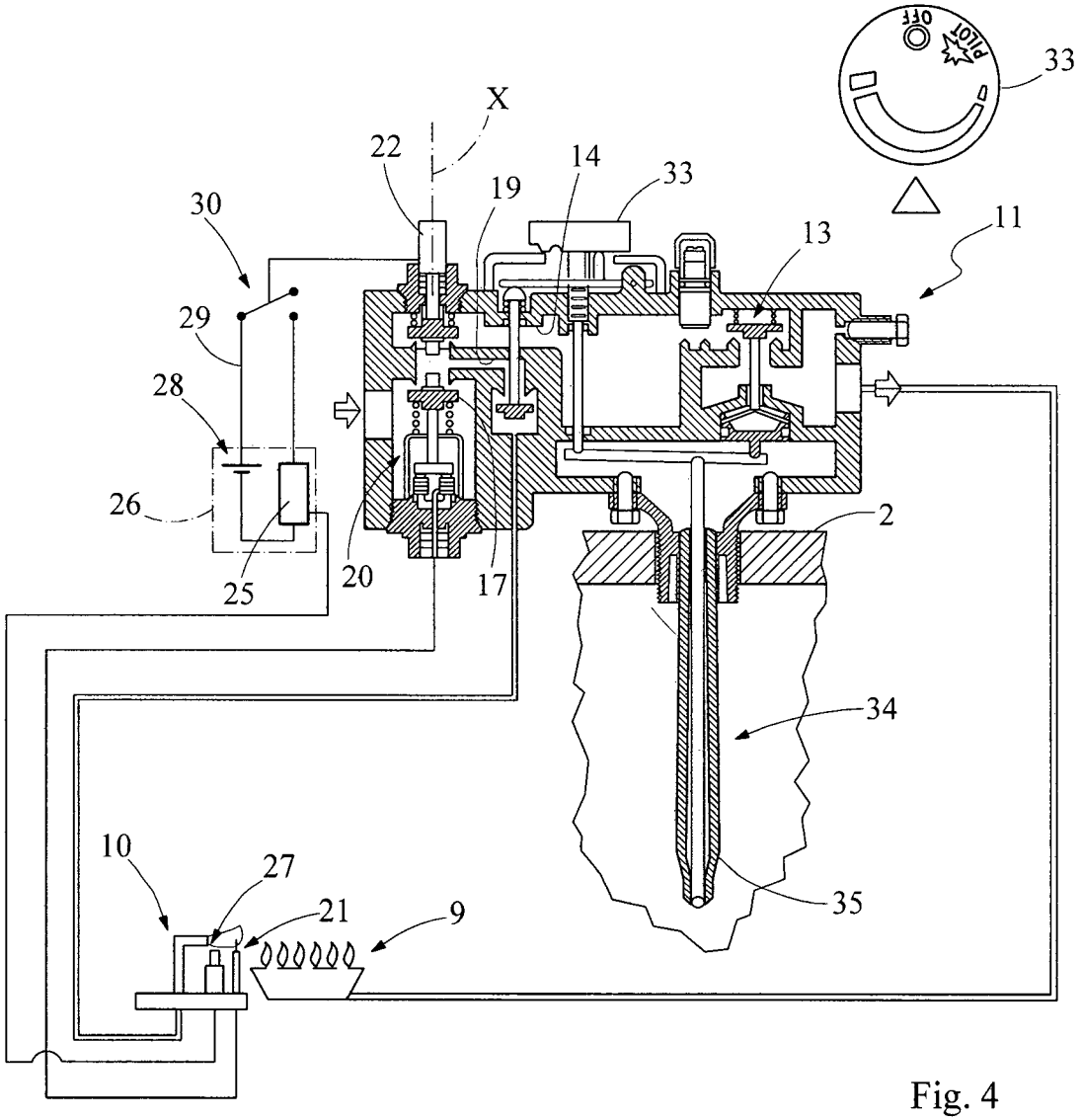

In one embodiment, the battery 28 can be housed in the body 26 itself of the igniter (as shown schematically in FIG. 2-4 by a dot-dashed line).

Figure 5:
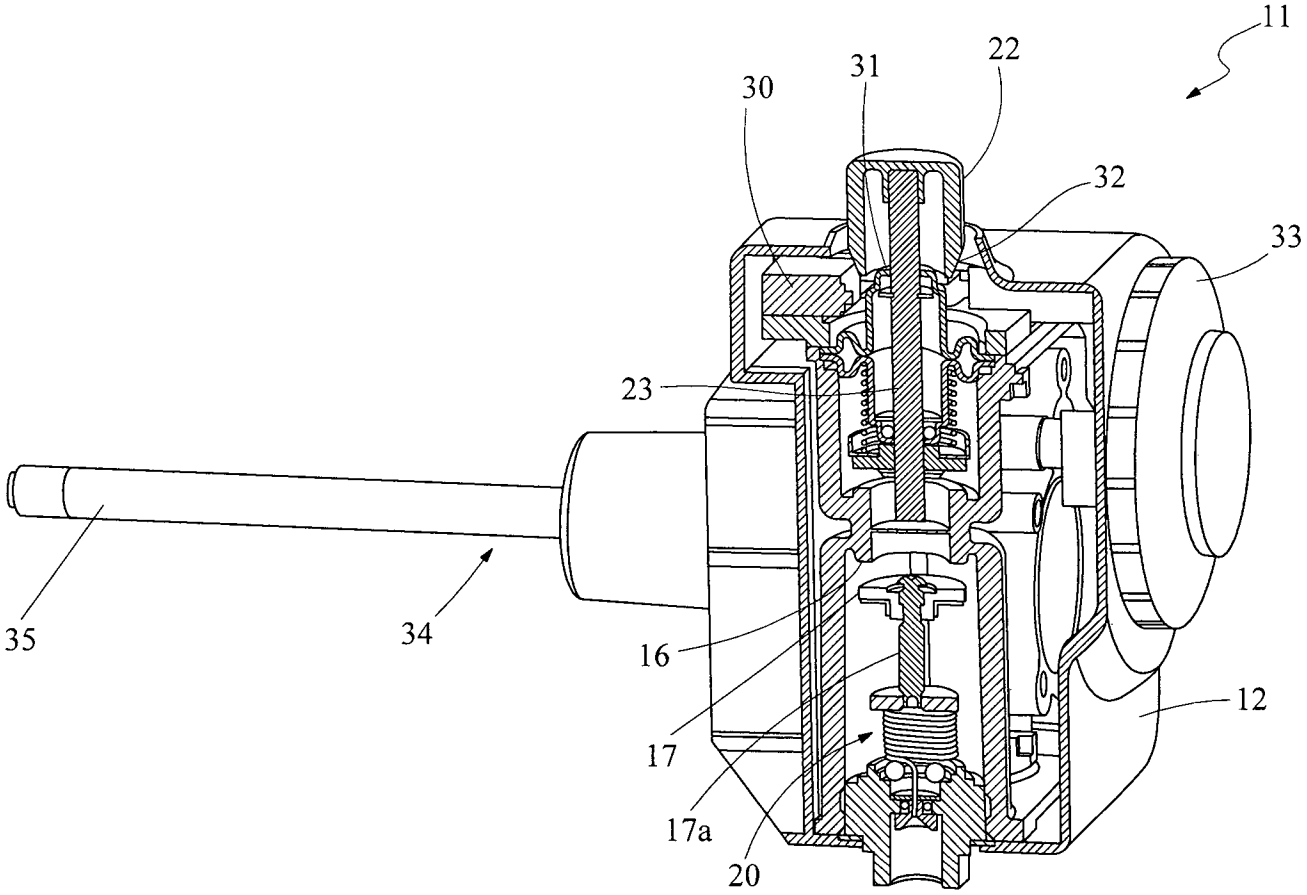
FIG. 5 is a partially sectional perspective view of another embodiment of the valve assembly that is designed to be operated in the water heater of the present invention.

The switch device 30 can also be designed as a micro-switch that acts on the electrical circuit 29 (as shown in FIG. 5), said micro-switch being provided with a button 31 that can be switched between the respective open and closed positions of the electrical circuit as a result of the button 31 interfering by means of a surface portion of the button 22 when the button moves downwards as the user presses it.

In more detail, with reference to the embodiment in FIG. 5, the button member 22 has a cylindrical cover on which a tapered portion 32 is formed at an end edge, said tapered portion being able to interfere with the button 31 of the switch device 30 when the button 22 moves in the axial sliding direction.

In this embodiment, the sliding movement of the button member 22 is perpendicular to the direction of movement of the button 31 of the switch.

33 marks a selector knob (in the form of a rotary knob, for example), which is operatively connected to a mechanical thermostat 34, the temperature-sensitive element 35 of which is housed inside the tank, in contact with the water stored therein.

The element 35 is suitably formed as a bimetalic differential expansion sensor and is suitable for acting, directly or indirectly, on the actuator rod of the shutter of the main valve in order to intervene in the opening/closing of the main valve according to the temperature reached by the water in the tank.

As shown in FIG. 2-4, the knob 33 can assume three positions, specifically an "OFF" position (FIG. 2), a "PILOT" position (FIG. 3) and a "CONTROL" position (from a minimum to a maximum, FIG. 4).

In order to allow for the ignition step, the knob 33 is rotated from the "OFF" position (non-operative state in FIG. 2) to the "PILOT" position (FIG. 3), thereby enabling the button 22 to be pressed to lead to the ignition of the main burner.

The process of igniting the main burner 9 advantageously provides for simple and convenient activation by the user. In fact, once the user has rotated the knob 33 into the "PILOT" position (FIG. 3), by pressing the button 22 with a finger, during the sliding motion of said button, the pilot valve 15 is opened and the circuit 29 that supplies power to the igniter 25 is simultaneously closed, thereby initiating the ignition process. Said process therefore provides for the opening of the pilot valve 15 (which allows the passage of gas towards the pilot burner 10) and for the ignition discharge at the electrode 27 of the ignition member. It should be noted that these actions require the user to press the button member just once, which, amongst others, can also be done using just one finger of your hand.

Once the pilot flame has been ignited, the magnetic assembly 20 that keeps the pilot valve 15 in the open position is energised by the voltage generated by the thermocouple 21, thereby allowing the gas to flow towards the main valve 13.

In this step, the user himself monitors whether or not the pilot flame is present, and, as soon as he detects the flame in the pilot burner, releases the button 22 that is moved back into the rest position by means of a springback action exerted by a return spring 22*a*.

After the main valve 13 has been opened, the ignition of the main burner 9 (FIG. 4) is controlled by the user setting the required temperature level to the desired level by rotating the selector knob 33 into the "control" position (between the minimum and the maximum).

It should be observed that, in one possible variant, the selector knob 33 and the button member 22 can be integrated in one another or can coincide, in this case the knob 33 is rotated into the "PILOT" position and then pressed in order to open the passage of gas to the pilot and to instigate the closure of the micro-switch of the electrical circuit of the ignition member.

The invention therefore achieves the set objects by achieving the advantages mentioned above with respect to the known solutions.

The advantages achieved by the water-heating apparatus formed in accordance with the invention include the fact that the process of igniting the pilot burner is more practical and convenient for the user, requiring just one movement (also carried out by just one finger or the palm of your hand) that exerts a pushing pressure towards the base of the button (or knob) of the actuating assembly. The use of an electrical ignition member of the type provided in the invention also makes it possible to automatically obtain a sequence of sparks, which are more reliable and effective at igniting the flame in the pilot burner compared with the solutions provided in the known water-heating apparatuses.

The invention claimed is:

1. Water-heating apparatus, comprising a combustible gas burner and:

a main burner (9), having a flame configured to heat water in a storage tank of the apparatus, a pilot burner (10), which is configured to generate a pilot flame for igniting the main burner (9), a valve assembly (11), which comprises a main valve (13), arranged on a main pipe (14) which supplies combustible gas to the main burner (9), and a pilot valve (15), which has a shutter (17) and is arranged on said main pipe (14), upstream of said main valve (13), which supplies gas to the pilot burner (10), a pilot pipe (19) branching off from a portion (14*a*) of the main pipe (14) that is interposed between said pilot valve and said main valve in order to supply the gas to the pilot burner (10), a magnetic thermoelectric safety assembly (20), which is manually actuated, comprising a thermocouple device (21) that holds the pilot valve (15) open in the presence of a flame in the pilot burner (10), and a button member (22), which is mounted on a rod (23) that is slidingly guided in the valve assembly (11) and is operatively associated with the shutter (17) of the pilot valve (15) in such a manner that, after pressure has been exerted on the button (22), said rod (23) is moved in a sliding direction until the rod (23) interferes with the shutter (17) of the pilot valve (15) in order to open said pilot valve, thereby allowing for the passage of gas, and an electrical ignition member (25) configured to generate sparks for igniting the pilot flame in the pilot burner (10), said ignition member (25) being supplied with power by a source of electrical power via an electrical connection circuit (29), a microswitch (30) being provided in the circuit (29) in order to open or close said electrical circuit, said microswitch (30) configured to be switched by the button member (22) so as to close the electrical circuit when said button member is pressed in order to carry out actuation of the magnetic assembly (20) so as to open the passage of gas through the pilot valve (15) towards the pilot burner (10) and to cause the pilot flame to be ignited by the sparks generated by the ignition member (25), wherein said microswitch is provided with a button (31) that is switchable between respective open and closed positions of said electrical circuit (29) after interference of said button (31) by a surface portion of the button member (22), and wherein said button member (22) has a cylindrical cover that has a tapered portion (32) at an end edge, said tapered portion (32) interfering with the button (31) of said switch device when the button member (22) moves in said sliding direction, wherein said sliding movement is perpendicular to a direction of movement of the button (31) of said microswitch (30).

2. The water-heating apparatus according to claim 1, wherein said ignition member (25) is supplied with power by a battery (28) and said micro-switch (30) is provided to allow or prevent power being supplied to the ignition member (25).

3. The water-heating apparatus according to claim 1, wherein, when energized, said ignition member (25) is designed to emit a string of sparks at a predetermined rate.

* * * * *